United States Patent [19]

Caletti

[11] 4,412,639

[45] Nov. 1, 1983

[54] DEFLECTOR AND INVERTER DEVICE FOR STRIPS OF WEB MATERIAL

[75] Inventor: Bruno Caletti, Casale Monferrato, Italy

[73] Assignee: Officine Maccaniche Giovanni Cerutti S.p.A., Alessandria, Italy

[21] Appl. No.: 301,825

[22] Filed: Sep. 14, 1981

[30] Foreign Application Priority Data

Nov. 4, 1980 [IT] Italy ..... 68685 A/80

[51] Int. Cl.[3] ..... B65H 23/32; B65H 19/04

[52] U.S. Cl. ..... 226/197; 226/199; 242/76

[58] Field of Search ..... 226/197, 199, 198; 242/76

[56] References Cited

U.S. PATENT DOCUMENTS

| | | | |
|---|---|---|---|
| 1,630,713 | 5/1927 | Meyer | 226/197 X |
| 1,938,447 | 12/1933 | Cole | 226/199 X |
| 2,619,057 | 11/1952 | Ellis | 226/197 X |
| 3,206,089 | 9/1965 | Huck | 226/197 E X |
| 3,623,645 | 11/1971 | Klingler | 226/197 E X |
| 3,809,303 | 5/1974 | Brunner | 226/197 E X |
| 3,954,213 | 5/1976 | Andersen | 226/197 E X |

*Primary Examiner*—Stanley N. Gilreath
*Assistant Examiner*—Dao Van Huynh
*Attorney, Agent, or Firm*—Pearne, Gordon, Sessions, McCoy, Granger & Tilberry

[57] ABSTRACT

A deflector and inverter device for strips of web material, in particular strips of paper, advancing in a given axial direction, in which each strip passes over an input roller perpendicular to the direction of advance of the strip upstream of the deflector device, and an output roller perpendicular to the input roller, and a deflector bar disposed in a position intermediate between the input and output rollers and supporting the section of the strip subtended between these latter; the intermediate deflector bar being substantially perpendicular to the output roller and being movable about an axis parallel to this latter between two symmetrical positions with respect to the said section of strip and forming with it an angle less than 45°.

4 Claims, 5 Drawing Figures

DEFLECTOR AND INVERTER DEVICE FOR STRIPS OF WEB MATERIAL

BACKGROUND OF THE INVENTION

The present invention relates to an inverting deflector device for strips of sheet material.

In particular, the present invention relates to a deflector and inverter device which can be used when it is necessary to deflect the direction of movement of a strip of sheet material by 90°, and when it is necessary to control the said strip in such a way that, after having been deflected, it is either the right way up or inverted.

The device forming the subject of the present invention, although usable with any type of flexible sheet material, can be used in a particularly advantageous way to deflect and, possibly, invert strips of paper advancing through a rotary printing press.

For simplicity and clarity, the following discussion will refer, without any loss of generality, to the particular mode of use specified above.

On rotary printing presses it is known to use, for each strip of printed paper supplied, for example, to the folding units, a deflector and inverter device normally constituted by a frame provided with bars, hereinafter indicated with the term "deflector bars", which form angles of 45° with the input direction of the associated strip. By turning the input strip over the previously mentioned deflector bars it is possible to deflect the strip itself by 90° to the right or to the left. Obviously, such a deflection automatically involves an inversion of the strip inasmuch as the surface which, at the input, faces, for example, upwardly, is on the other hand facing downwardly after the deflection.

For the purpose of avoiding the said inversion, in the cases where such is desired, the known deflector and inverter devices are provided laterally of the said deflector bars, and on opposite sides of these, with inverter rolls the function of which is immediately clear if one takes into consideration a practical case. If it is desired, for example, to deflect a strip of paper by 90° in such a way that it shall not be inverted at the output, the strip itself is first passed over one of the previously mentioned inverter rolls and then onto the deflector bar which deflects it towards the right.

The use of the above described known deflector devices involves numerous disadvantages the main one of which is constituted by the friction which develops at the contact between the strips and the said deflector bar. Such friction is normally reduced by providing a plurality of holes on the bars for compressed air operable to form an air cushion under the strips. However, given the extent of the surface contact between the strips and the associated deflector bars it is necessary to adopt supply systems for the compressed air which are complicated and relatively costly in themselves.

Another disadvantage derives from the use of the said inverter rolls which, if used, extend the path of the strips of paper causing problems when the inverted strips must be combined with non-inverted strips.

SUMMARY OF THE INVENTION

The object of the present invention is that of providing a deflector and inverter device which shall not only be structurally simpler than the previously mentioned known devices, but also free from the above described disadvantages.

The said object is achieved by the present invention in that it relates to a deflector and inverter device for strips of sheet material, particularly strips of paper, movable axially through the device itself, the latter being characterised by the fact that it comprises, for each said strip, an input roll and an output roll disposed at substantially 90° relative to the input roll, which is perpendicular to the direction of advance of the strip itself upstream from the said input roll, and a deflector bar disposed in an intermediate position with respect to the said input and output rolls and operable to support a section of the strips subtended between these rolls; the said bar being movable about an axis parallel to the output roll to assume, selectively, two symmetrical positions with respect to the said section of the strip, in each of which the said bar forms an angle less than 45° with the said section of the strip.

BRIEF DESCRIPTION OF THE DRAWINGS

Further characteristics and advantages of the present invention will become apparent from the following description with reference to the attached drawings, which illustrates an exemplary and non limititive embodiment, in which.

DETAILED DESCRIPTION OF THE INVENTION

Figure 1:
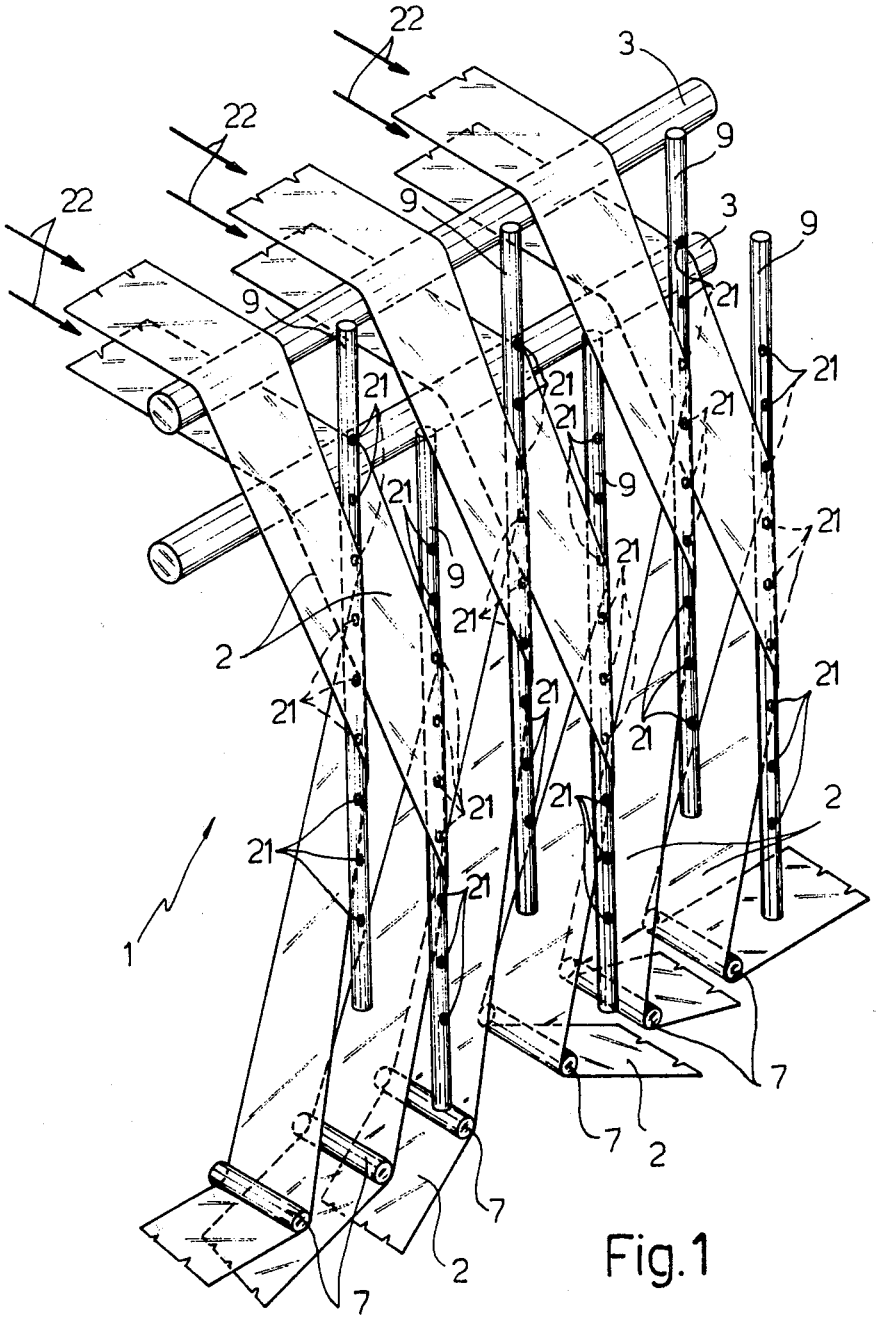
FIG. 1 is a perspective and schematic view of a deflector and inverter device formed according to the principle of the present invention.

The above listed drawings illustrate a deflector and inverter device generally indicated 1 operable to deflect, and possibly to invert, a plurality of strips 2 of paper movable through the device 1 itself to the left or to the right by 90°.

The device 1 includes, for each strip 2 an input roller 3, mounted rotatably on a shaft 4 (FIG. 2) supported at the ends by the brackets 5 extending from a base plate 6 parallel to the roller 3.

The device 1 further includes, for each strip 2, an output roller 7 perpendicular to the plate 6 and rotatably mounted on a support 8 anchored thereto, and a cylindrical deflection bar 9 disposed in an intermediate position with respect to the rollers 3 and 7 The bar 9 is positioned facing the plate 6 and on the same side of the roller 7 with respect to the plate 6. The bar 9 is centrally connected to a support shaft 10, which is parallel to the output roller 7 and is rotatably mounted on a slide 11. This slide is slidably mounted on a guide 12 extending along the plate 6 in a direction parallel to the shaft 4 and has a lateral projection 13 provided with a threaded through hole which is engaged by a screw 14 the rotation of which affords displacement of the slide 11 along the guide 12.

Figure 5:
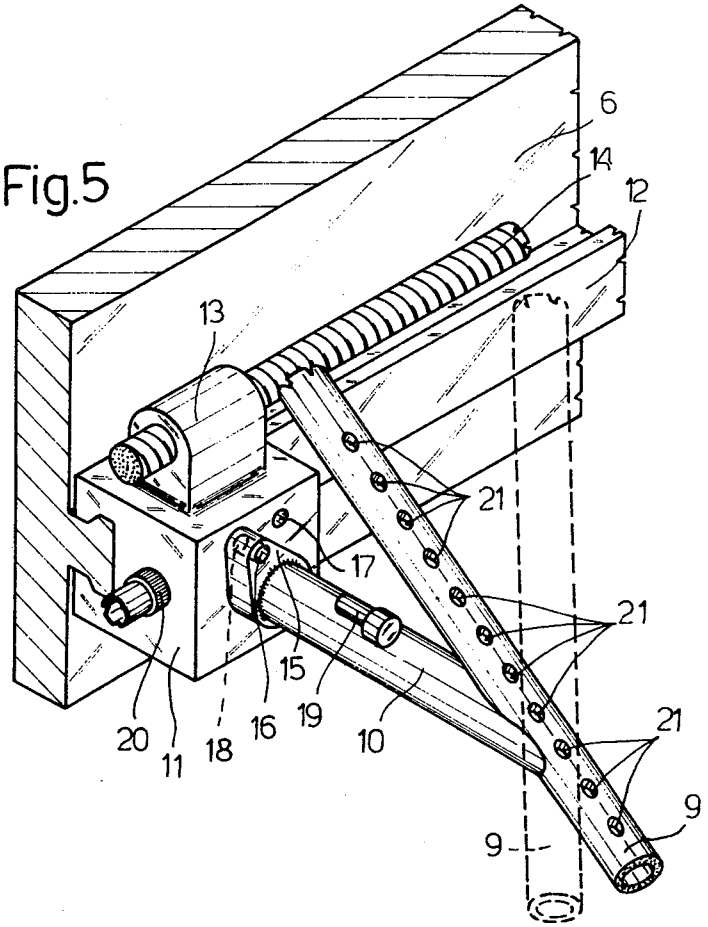
FIG. 5 is an enlarged perspective view of a detail of FIG. 2.

As illustrated, in particular in FIG. 5, the shaft 10 is provided with a collar 15 having a hole 16 which can be aligned, selectively by means of a rotation of the shaft 10, with 2 holes 17 and 18 formed on the slide 11. A pin 19 mounted through the hole 16 and one or the other of the holes 17 or 18 can be engaged to fix the bar angularly in two symmetrical positions with respect to an axis parallel to the plate 6 and perpendicular to the roller 3, and in which the bar 9 forms angles less than 45° with this axis.

As illustrated, in particular in FIG. 5, the bar 9 is tubular and is connected through the shaft 10 which is also tubular to a coupling 20 mounted on the slide 11 and operable to permit the supply of compressed air to the interior of the bar 9 from where it flows out through a plurality of holes 21 uniformly distributed along a reduced surface region extending along a generatrix of the bar 9 facing the strip 2.

Figure 2:
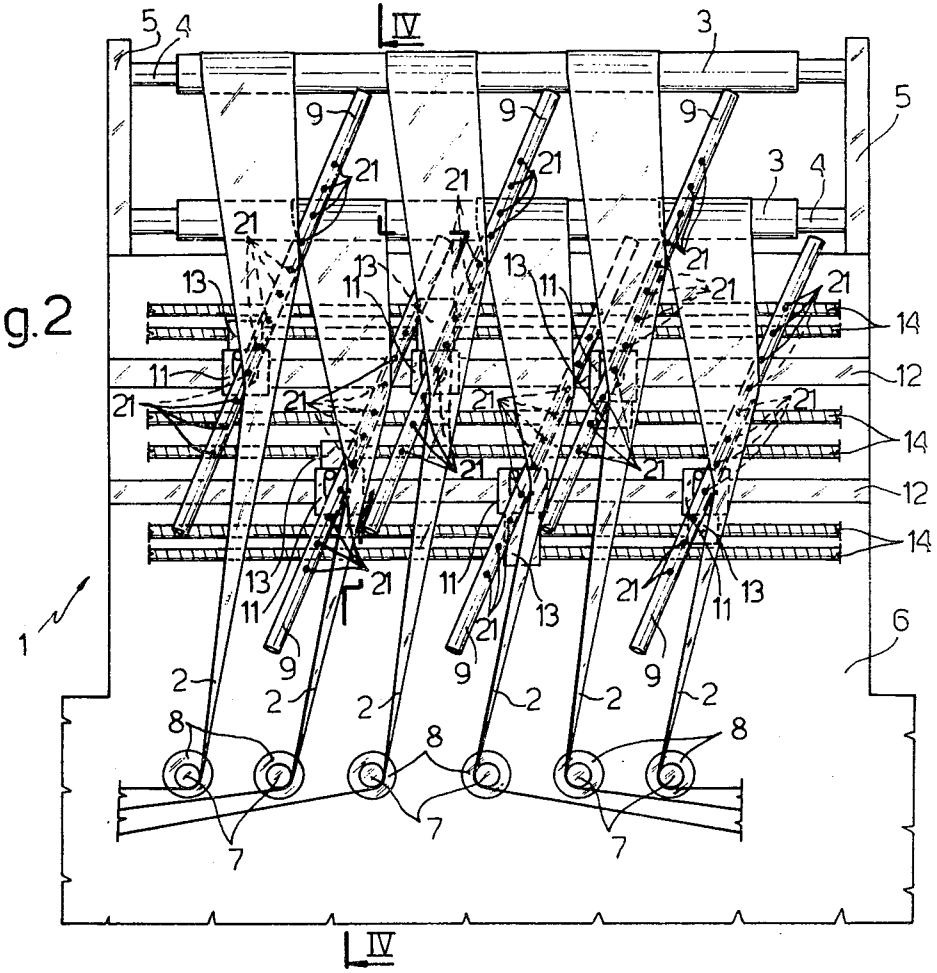
FIG. 2 is a front view of the device of FIG. 1.
Figure 4:
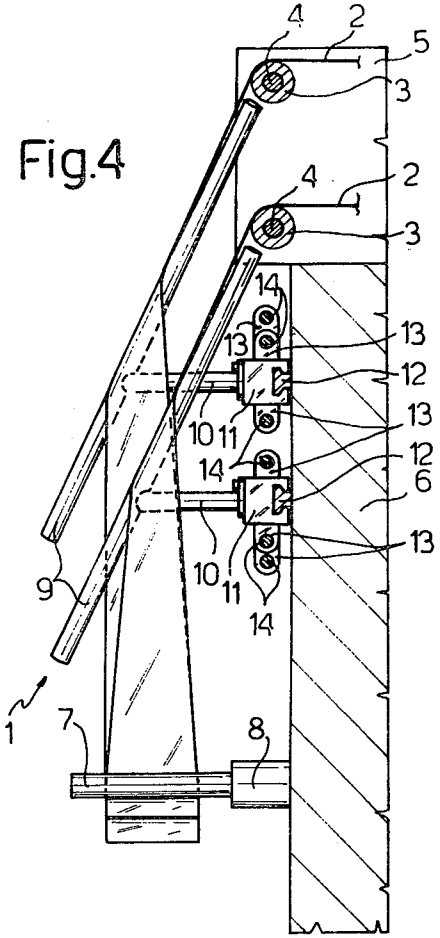
FIG. 4 is a section taken on the line IV—IV of FIG. 2.
Figure 3:
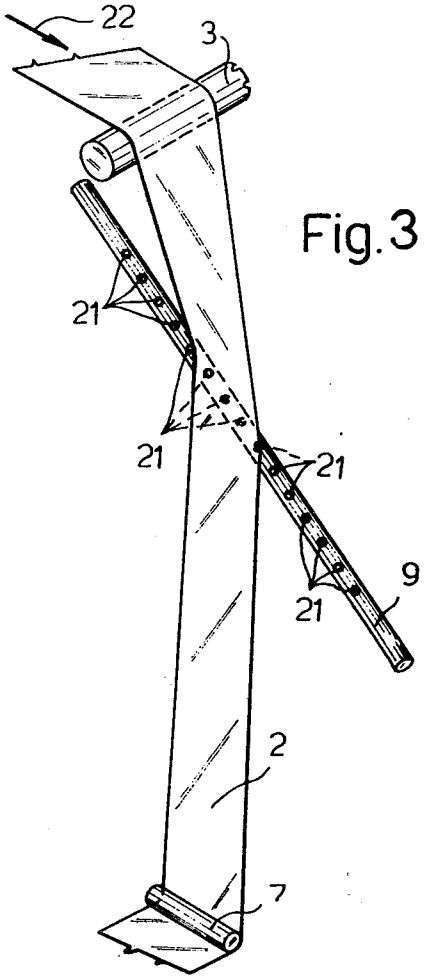
FIG. 3 is a perspective view of a detail of FIGS. 1 and 2 in a different operating position.

In use, before mounting the strip 2, the position of the slide 11 is adjusted in dependence on the width of the strip of paper to be mounted and, subsequently, the angular position of each bar 9 is adjusted by carrying the associated hole 16 into alignement with the hole 17 or else with the hole 18 of the associated slide 11 according as it is desired to invert the strip 2 (FIGS. 1 and 2) or else to maintain it in its original orientation (FIGS. 3 and 5).

As is clearly illustrated in FIGS. 1, 2 and 3, each strip 2 passing through the device 1 first turns about the input roller 3 in such a way that its direction upstream of the device 1, indicated with an arrow 22 in FIGS. 1 and 3, is deflected by the roller 3 by an angle in the region of 90° towards the plate 6. Subsequently, each strip 2 is passed over the associated bar 9 and turned about the associated output roller 7 thereby being deflected towards the left or towards the right in dependence on the direction with which the strip 2 itself is wound over the output roller 7. The section of the strip 2 subtended between the rollers 3 and 7 is arranged substantially as a helix which is supported by the bar 9 at its central part.

Given the relatively reduced inclination of the bar 9 with respect to the said axis of the section of the strip 2 lying between the rollers 3 and 7 the stresses imparted to the strip 2 by the contact with the bar 9 are relatively reduced. Moreover, since the said section of the strip 2 runs over a trajectory which is substantially tangential to the bar 9 the surface of this latter brushed by the strip 2 is relatively reduced in such a way that even small holes 21 are sufficient to reduce the friction between the bar 9 and the strip 2 substantially to zero.

As a consequence of what has been explained above, the distribution of compressed air to the bar 9 will require the use of a system (not illustrated) of relatively reduced capacity and power.

From FIGS. 1 and 3 it is clearly apparent how the strip 2 can be inverted or not without making use of inverter rollers, but simply by adjusting the angular position of the bars 9 about the axes of the associated shafts 10 independence on the direction which each strip 2 turns about the associated output roller 7. In this way the length of the path followed by each strip 2 between the associated rollers 3 and 7 remains constant and independent of whether the strip 2 is inverted or not.

I claim:

1. A deflector and inverter device for axially movable strips of flexible sheet material comprising for each of the strips: an input roller perpendicular to the direction of advance of the strip; an output roller disposed at substantially 90° relative to said input roller; and a deflector bar disposed in an intermediate position with respect to said input and output rollers and operable to support a portion of the strip extending between said rollers means for supporting said bar for rotation; about an axis parallel to said output roller to assume, selectively, two symmetrical positions with respect to said portion of the strip; in each of said positions said bar forming an angle less than 45° with said portion of the strip.

2. A device as claimed in claim 1, wherein each said bar and the corresponding output roller is arranged on the same side of a plane containing the axis of the corresponding input roller and perpendicular to the axis of said output roller.

3. A device as claimed in claim 1, characterised by the fact that the said bar has output holes for compressed air along a generatrix of the bar facing the said portion of the strip.

4. A device as claimed in claim 1 or 2, further comprising, for each strip, a slide supporting a corresponding one of said bars; guide means for said slide extending parallel to said input rollers; and actuating means for displacing said slide along said guide means.

* * * * *